United States Patent [19]

Riggs

[11] 4,267,215

[45] May 12, 1981

[54] PROCESS FOR COATING A WEB USING REVERSE APPLICATOR ROLL

[75] Inventor: Aubrey F. Riggs, Knebworth, England

[73] Assignee: Imperial Chemical Industries Limited, London, England

[21] Appl. No.: 913,004

[22] Filed: Jun. 5, 1978

[30] Foreign Application Priority Data

Jun. 23, 1977 [GB] United Kingdom ..... 26307/77

[51] Int. Cl.[3] ..... B05D 3/02

[52] U.S. Cl. ..... 427/372.2; 118/246; 427/385.5; 427/388.1; 427/391; 427/393.5; 427/428

[58] Field of Search ..... 427/385 R, 428, 445, 427/372.2, 385.5, 388.1, 391, 393.5; 118/6, 112, 246, 224

[56] References Cited

U.S. PATENT DOCUMENTS

| | | | |
|---|---|---|---|
| 3,029,780 | 4/1962 | Justus et al. | 118/126 |
| 3,239,367 | 3/1966 | Demeter | 118/246 |
| 3,533,833 | 10/1970 | Takahashi et al. | 427/428 X |
| 3,844,813 | 10/1974 | Leonard et al. | 118/246 |
| 3,862,553 | 1/1975 | Schwemmer et al. | 118/6 X |
| 3,931,786 | 1/1976 | Teed | 118/6 |

FOREIGN PATENT DOCUMENTS

| | | | |
|---|---|---|---|
| 1427602 | 11/1968 | Fed. Rep. of Germany . | |
| 1577669 | 4/1970 | Fed. Rep. of Germany . | |
| 2730908 | 2/1978 | Fed. Rep. of Germany . | |
| 2270957 | 12/1975 | France . | |
| 1133913 | 11/1968 | United Kingdom | 427/428 |
| 1151690 | 5/1969 | United Kingdom . | |
| 1345618 | 1/1974 | United Kingdom . | |
| 1457940 | 12/1976 | United Kingdom . | |

*Primary Examiner*—Ronald H. Smith
*Assistant Examiner*—Thurman K. Page
*Attorney, Agent, or Firm*—Cushman, Darby & Cushman

[57] ABSTRACT

Process and apparatus for applying a flowable coating medium to a travelling web by a reverse applicator roll technique in which the peripheral velocity of the applicator roll (U) is maintained at less than 0.4 of the forward speed of the web, and the dynamic viscosity of the coating medium ($\eta$) is selected in accordance with the relationship $$h = k\eta^{0.5}U^{0.5},$$

wherein k is from 0.01 to 100, such that a layer of coating medium of equilibrium thickness (h) not exceeding 5.0 mm is entrained on the surface of the applicator roll for transfer to the web. The technique avoids the use of a doctor blade to meter the amount of coating medium on the applicator roll, and is suitable for the high speed application of a heat sealable coating layer onto a polymeric packaging film. Coating quality can be improved by stabilizing the web downstream of the applicator roll.

12 Claims, 3 Drawing Figures

PROCESS FOR COATING A WEB USING REVERSE APPLICATOR ROLL

This invention relates to a method and apparatus for coating a web, and, in particular, to a method of applying a coating to at least one surface of a web by a reverse roll technique.

A web is considered to be any material in laminar form capable of being fed from a roll or other source of supply, subjected to a process treatment, and subsequently rewound in roll-form, or cut into sheets or otherwise converted for use by a consumer. Typical webs include paper, and plastics films.

The term "coating" is used throughout this specification to describe both the process of depositing a liquid or flowable material, including printing inks, in a controlled manner on to a surface of a moving web, and the layer of material so deposited on that surface either in the wet state or in a subsequently dried condition.

For many years successful coating of webs, particularly of paper, has been effected by means of a transfer roll technique in which a flowable coating medium is metered onto a rotating applicator roll and thence wiped directly onto a surface of a travelling web. A reverse roll technique in which the applicator roll contra-rotates relative to the direction of movement of the web has gained wide-spread acceptance by virtue of the considerable latitude in coating viscosity and coat thickness thereby permitted.

A principle of the reverse roll technique is that the supply of coating medium to the applicator roll surface should be controlled by mechanical metering means, such as a flexible doctor blade or an associated doctor roll cooperating with the applicator roll, to ensure that the requisite volume of coating medium is entrained on the applicator roll surface and thence deposited on the web surface. However, there is a tendency for the coating medium to dry out and form crusts on the mechanical metering means, for example on the edge of the doctor blade, or for particles of grit or other contaminants to accumulate on the doctoring device, with consequent disruption of coating uniformity. Reciprocation of the metering means parallel to the axis of the applicator roll has therefore been proposed to overcome this problem, but serves simply to randomize the distribution of coating defects on the web surface rather than achieving elimination of these defects.

A further principle of the conventional reverse roll coating technique is that the web should be partially wrapped around the resilient surface of a support or backing roll which rotates in the direction of movement of the web and cooperates with the applicator roll to define a "nip" through which the web passes. In an arrangement of this kind the web makes only line contact with the surface of the applicator roll and consistently uniform coating behaviour is difficult to achieve.

A still further principle of the reverse roll technique is that the deposited coating medium should be wiped onto the web surface by the applicator roll to assist the production of a smooth coating on the web. The applicator roll is therefore usually rotated at a peripheral speed at least equal to, and preferably exceeding, the linear speed of the travelling web, the latter seldom exceeding 700 feet/minute (3.5 $ms^{-1}$). In practice, the wipe ratio, which is the ratio of the speed of the applicator roll to that of the web, is conventionally within a range of from 1:1 to 3:1. With the advent of increasingly high speed coating technology the need to maintain a positive speed differential between the applicator roll and web has increased the difficulty of achieving coating uniformity. For example, transverse ridges or "chatter" marks, resulting from vibration of the web and applicator roll, appear in the applied coating. Furthermore, the necessarily high roll speed results in increased wear and diminished life of the bearings in which the applicator roll is rotatably mounted.

We have now devised a reverse roll coating method whereby the aforementioned defects are reduced or eliminated.

Accordingly, the present invention provides a method of coating a surface of web comprising forwarding the web in contact with the surface of an applicator roll, supplying a flowable coating medium to the surface of the applicator roll, and rotating the applicator roll in a direction contrary to the direction of forward movement of the web, characterised in that the dynamic viscosity of the coating medium and the peripheral velocity of the applicator roll are each selected in accordance with the relationship $$h = k\eta^{0.5}U^{0.5}$$

such that a layer of coating medium of equilibrium thickness not exceeding 5.0 mm is entrained on the surface of the applicator roll for transfer to the surface of the web, and the ratio of the peripheral velocity of the applicator roll to the forward speed of the web is maintained at a value not exceeding 0.4:1, wherein

- h is the equilibrium thickness (mm) of the entrained coating medium on the applicator roll surface,
- k has a value of from 0.01 to 100,
- $\eta$ is the dynamic viscosity ($Nsm^{-2}$) of the coating medium, and
- U is the peripheral velocity ($ms^{-1}$) of the applicator roll.

The invention also provides an apparatus for applying a liquid coating medium to a surface of a travelling web comprising an applicator roll rotatable in a direction contrary to the direction of travel of the web, a reservoir for supplying liquid coating medium to the surface of the applicator roll, and means for forwarding the web in contact with the surface of the applicator roll characterised by guide means for maintaining the web in engagement with the surface of the applicator roll over an arc contact angle of from 5° to 90°, by the absence of means cooperating with the applicator roll surface for metering coating medium thereon, and by means for rotating the applicator roll counter to the direction of travel of the web at a peripheral velocity not exceeding 0.4 of the forward speed of the web such that, in the absence of said metering means, a uniform layer of coating medium having an equilibrium thickness not exceeding 5.0 mm can be entrained from the reservoir onto the surface of the applicator roll for transfer to the web surface.

The invention further provides a coated web prepared by the aforementioned method.

The applicator roll which may be in the form of a solid bar, or, preferably, a hollow tube with provision for circulation therethrough of coolant medium such as chilled water, is suitably formed from mild steel, the surface of the roll being sufficiently smooth to ensure the deposition of a uniform coating on the web. Preferably, the surface of the roll is chromium plated and polished to a suitable degree of smoothness—for example, a surface texture with an Arithmetical Mean Deviation, Ra, (commonly referred to as Centre Line Average surface roughness) according to British Standard 1134 of 1972 of from 0.2 to 0.05 μm (8 to 2 microinches), and preferably about 0.1 μm (4 microinches).

In practice, the applicator roll is positioned with its rotational axis substantially normal to, and parallel to the plane of, the direction of movement of the travelling web, provision being made, if desired, for varying the roll position relative to the web to achieve the required degree of coating uniformity. Suitably the axial length of the roll is such that the roll projects beyond each longitudinal edge of the web so that the entire surface of the web may be coated, and in the case of wide webs, for example of the order of 48 inches (1.2 m), the rigidity of the roll may be improved, if desired, by the provision between the ends of the roll of at least one intermediate supporting member, such as a semi-cylindrical shell bearing, cooperating with the roll surface. Suitably the supporting member comprises a self-lubricating bearing surface of a material such as the 'Fluon' brand of polytetrafluoroethylene, 'Fluon' being a registered Trade Mark of Imperial Chemical Industries Limited.

In the absence of a doctor blade or other mechanical metering mens cooperating with the applicator roll the continuous transfer to the web surface of the requisite amount of coating medium depends, inter alia, on the viscosity characteristics of the medium and on the geometry of the applicator assembly. Particularly satisfactory coating behaviour has been observed with an applicator roll of relatively small diameter compared to that employed in conventional reverse roll coating equipment, and it is therefore preferred that the diameter of the applicator roll should be within a range of from 25 to 102 mm, preferably about 50 mm.

The applicator roll rotates in a direction contrary to the direction of movement of the travelling web, and by adjusting the peripheral speed of the applicator roll to a value considerably less than the linear speed of the web it is possible to ensure that the applicator roll picks up from a suitable supply source only that amount of coating medium required to deposit a coating of the desired thickness on the web surface. An independent metering roll or doctor blade cooperating with the applicator roll is therefore not required.

Because of the large speed differential between the web and applicator roll, substantially all of the coating medium entrained on the surface of the rotating applicator roll in the region of contact with the web is transferred to the web surface, and is there spread out to provide a uniform coating of the desired thickness on the web surface, thereby eliminating the need for additional mechanical metering means cooperating with the coated surface of the web. In practice, the peripheral speed of the applicator roll is conveniently within a range of from 0.001 to 0.4 of the linear speed of the web, although a considerable speed differential is preferred such that ratio of the roll to web speeds is from 0.01:1 to 0.3:1, preferably from 0.015:1 to 0.15:1, and particularly preferably from 0.02:1 to 0.05:1. For example, a polyolefin web travelling at 1500 feet/minute (7.6 meters/sec) is conveniently coated by an applicator roll contra-rotating at a peripheral speed of 50 feet/minute (0.25 meters/sec), i.e. a roll to web speed ratio of about 0.033:1. Desirably, the peripheral speed of the applicator roll is within a range of from 1 to 500 feet/minute (0.005 to 2.5 meters/sec), and preferably is maintained between 10 and 150 feet/minute (0.05 to 0.76 meters/sec).

Rotation of the applicator roll at a suitable peripheral speed is effected by conventional driving means. For example, a pulley-mounted endless belt system coupled to a prime mover, such as an electrical motor, provides a conveniently smooth, variable-speed drive means for the applicator roll without requiring a complex gearing system.

The coating system of the present invention, operating, as it does, in the absence of mechanical metering means cooperating with the applicator roll, depends, inter alia, on the establishment of an appropriate relationship between the peripheral speed of the applicator roll and the viscosity characteristics of the coating medium to ensure that the correct amount of coating medium is entrained on the roll surface at the area of contact with the web to ensure transfer to the web surface of a coating layer of the desired thickness. The peripheral speed of the applicator roll should therefore be controlled in accordance with the relationship:

$$h = k\eta^{0.5}U^{0.5},$$

wherein the symbols represent the hereinbefore specified parameters.

The thickness of the wet coating layer deposited on the web is, of course, reduced (compared to h-the equilibrium thickness of the entrained coating medium on the applicator roll surface) in proportion to the ratio of speeds of the roll and web.

Coating medium picked up from a suitable source or reservoir by the applicator roll is conveyed on the surface thereof to the junction at which the coated web disengages from the contra-rotating roll. At this junction is established a distinct wedge or "bead" of coating medium supported by contact with both the web and roll. As rotation of the roll conveys coating medium towards the web there is established on, and supported only by, the roll surface, a layer of coating medium the thickness of which depends on the equilibrium balance achieved between the volume of coating medium forwarded under the influence of surface tension and inertia forces interacting with the roll and the volume of coating medium flowing from the roll surface under gravity. It is the thickness of this layer, immediately before it merges into the "bead", measured in a direction radially outwards from the rotational axis of the applicator roll which is herein referred to as the "equilibrium thickness" (h) of the entrained coating medium. The thickness of layer h, which should not exceed 5.0 mm and is preferably from 0.025 to 0.5 mm, is conveniently measured by conventional techniques—for example by means of a travelling microscope radially directed towards the applicator roll axis and focussed in turn on the roll surface and on the outermost surface of the coating layer entrained thereon. Alternatively, a knowledge of the solids content and density of the coating medium and of the relative speeds of web and applicator roll enables the thickness of layer h to be derived from the measured thickness of the dry coating on the web surface by simple calculation—on the basis that all of the coating medium entrained on the roll surface is spread onto the web.

The value of k in the aforementioned relationship is from 0.01 to 100 and is preferably from 0.1 to 50. In general, k is desirably maintained within a range of from 0.25 to 25, preferably from 0.5 to 10, a preferred specific value of k being 3.7.

The dynamic viscosity of the coating medium may vary over a wide range—for example, from 1 centipoise (water thin) to the order of 50,000 centipoise, i.e. from about 0.001 to 50 $Nsm^{-2}$, measured at 20° C., but the low applicator to web speed ratio technique of this invention has proved particularly effective with coating media of relatively low viscosity—for example from 0.001 to 1.0 $Nsm^{-2}$, and particularly from 0.001 to 0.1 $Nsm^{-2}$, a preferred dynamic viscosity range being from 0.0015 to 0.06 $Nsm^{-2}$ at 20° C.

To avoid the deposition of ridged or otherwise non-uniform coatings, caused, for example, by the presence of pucker lanes in, or general lack of planarity of, the web fed to the applicator roll, it is preferred that simple line contact between the web and applicator roll is avoided during the coating operation. Preferably, therefore, the web cooperates with the applicator roll over an arcuate segment of the roll surface such that the web is spread uniformly on the roll surface. Suitably, the arc contact angle, being the angle at the rotational axis of the roll subtended by that arc of the roll surface engaged by the web, has a minimum value of 5°, and may be increased to any value at which an improvement in the quality of the deposited coating is discernible. In practice, the maximum value of arc contact angle is determined by the geometry of the system and will seldom exceed 90°. Preferably, an arc contact angle of from 8° to 45° is employed.

In conventional reverse roll coating techniques the web is partially wrapped around a resilient-surfaced backing roll cooperating with the applicator roll to define a nip through which the web travels, the separation between the nip rolls being maintained equal to the combined thickness of the web and the coating deposited thereon. Consequently, there is a high risk of damage to the web, in the nip, resulting from the speed differential between the backing roll, which rotates at the same speed and in the same direction as the web, and the contra-rotating applicator roll. The present invention enables reverse roll coating to be effected in the absence of a backing roll. However, to prevent vibration of the web in the absence of a backing roll, it is preferred that the path of the web be stabilised by engagement of the web with web stabilising means positioned downstream of the applicator roll. The web stabilising means suitably comprises a relatively rigid member—for example, of aluminium with a suitably polished surface, extending across the width of the web and cooperating with the opposed surface of the web to that engaging the applicator roll, the member engaging the web downstream of the point at which the web ceases to contact the applicator roll and sufficiently close thereto to reduce vibration of the web to an acceptable magnitude in the vicinity of the applicator roll. The stabilising member may be a stationary rod or bar, or, preferably, a roll rotatable in the direction of travel of the web. Desirably, the diameter of the stabilising roll should exceed that of the applicator roll, the diameter ratio of stabilising to applicator roll being preferably within a range of from 1.01:1 to 4:1.

The coated web formed by transfer of the coating medium from the applicator roll to the web may be subjected to conventional treatments. Thus, if desired, smoothing of the applied coating layer may be effected by contacting the coated surface with a smoothing assembly comprising, for example, at least one polished rod or bar, or, preferably, a plurality of smoothing rolls at least some of which rotate in a direction contrary to the direction of travel of the web. Typical smoothing rolls are of mild steel with a chromium plated and polished surface.

Coatings applied in accordance with the present invention may be dried, if necessary, by conventional methods, for example—by passing the coated web through an air oven maintained at an appropriate temperature. A float oven in which the coated web floats on a current of heated air is particularly suitable.

The speed at which webs may be coated according to the invention depends on several factors including the material of the web and the thickness of the applied coatings. However, we have observed that polymeric films are suitably coated at relatively high linear speeds—for example of the order of 1,200 to 2,000 feet per minute (6 to 10 meters/second), i.e. at significantly higher speeds than attained by conventional reverse roll coating techniques.

The method of the invention is applicable to the coating of a single web surface or, if desired, to the sequential application of coating medium to each of the two opposed outermost surfaces of a web. In the latter case, sequential coating stations may be followed by a single smoothing assembly, with smoothing members cooperating with each coated surface, and, if desired, by a single oven assembly for simultaneously drying both coated surfaces of the web.

The technique of the present invention is suitably employed for the application of a variety of liquid coating media, but is particularly suitable for the application of a heat-sealable coating medium to a web surface. In particular, a heat-sealable coating medium may be applied to a polymeric web the surface of which has already been treated with a primer medium—such as an interpolymerised condensation resin of the kind described in British Pat. No. 1,134,876 or in British Pat. No. 1,174,328.

Suitable flowable, polymeric, heat-sealable coating media include copolymers of vinylidene chloride with acrylonitrile because they yield hard coatings with good heat-seal strengths, and are also resistant to moisture and have low gas permeability. It is preferred to use copolymers containing between 80% and 95% by weight of vinylidene chloride with from 5% to 20% by weight acrylonitrile. These copolymers may contain other monomers such as acrylic acid, itaconic acid and methacrylic acid, but a particularly preferred heat-sealable resin comprises a copolymer containing 88 weight % of vinylidene chloride and 12 weight % of acrylonitrile. The heat-seal coating medium may be applied to the web as a solution or a dispersion, but the solvent or dispersant should not be such that it will dissolve any resin coating already on the web surface. For economic reasons application as an aqueous dispersion is preferred. A vinylidene chloride-acrylonitrile copolymer coating medium is conveniently employed as an aqueous dispersion containing from about 30 to about 60% by weight of the copolymer based on the weight of the dispersion, i.e. a dispersion having a dynamic viscosity range at 20° C. from about 0.0015 to about 0.06 $Nsm^{-2}$.

Coating medium may be supplied to the surface of the, or each, applicator roll by conventional techniques—for example, by partial immersion of the rotating applicator roll in a bath containing a volume of the liquid coating medium, the roll preferably being immersed to the level of its rotatitonal axis in the medium.

The thickness of the coating applied to the, or each, surface of the web, can be adjusted, inter alia, by appropriate selection of the rotational speed of the applicator roll. A heat-sealable resin, of the kind hereinbefore described, is suitably deposited on a polymeric web to form a coating having a wet thickness, i.e. prior to drying, of the order of from 1 to 100 μm, but, to facilitate drying, the wet thickness of the coating is desirably maintained between 1 and 25 μm, preferably from 1.5 to 10 μm, and particularly preferably from 2 to 8 μm. In practice, the wet thickness of the coating may be varied over a wide range depending on the solids content of the coating medium and the desired thickness of the subsequently dried coating. The thickness of the coatings on opposed surfaces of the web may, but neet not, be identical. The equilibrium thickness of the coating medium entrained on the applicator roll will be correspondingly greater than the wet coat thickness on the web—approximately in proportion to the ratio of the speed of the web to that of the applicator roll.

Coatings applied in accordance with the present invention may contain agents, such as anti-static agents, anti-oxidants, ultra-violet light stabilisers, and the like, to control or improve the characteristics of the coated web.

Webs such as paper, paperboard, cellulosic films, metal foils, polymeric films, and laminates thereof, are suitably coated or printed by the techniques of the present invention. Typical polymeric films include oriented, particularly biaxially oriented, films formed in conventional manner from polyesters such as polyethylene terephthalate and polyethylene-1,2-diphenoxyethane-4,4′-dicarboxylate, and from polymers and copolymers of 1-olefins such as ethylene, propylene, butene-1, and 4-methylpentene-1. A particularly useful thermoplastic polymer film is that formed from a high molecular weight stereoregular predominantly crystalline polymer of propylene, either in the form of a homopolymer or copolymerised with minor quantities (e.g. up to 15% by weight of the copolymer) of at least one other unsaturated monomer, such as ethylene.

Films treated according to the present invention may vary in thickness depending on the intended application, films having a thickness of from 2 to 150 microns being of general utility. Films intended for use in packaging operations are suitably within a thickness range of from 10 to 50 microns.

The technique of the invention is capable of industrial exploitation to produce packaging films, and in a preferred embodiment of the invention a heat sealable polyolefin film is prepared by forwarding an oriented polyolefin film in contact with the surface of an applicator roll, supplying a solution or dispersion of a heat sealable coating medium to the surface of the applicator roll, rotating the applicator roll in a direction contrary to the direction of forward movement of the film to coat the film, and drying the coated film, characterised by maintaining the film in contact with the applicator roll surface over an arc contact angle of from 5° to 90°, by supplying to the applicator roll surface a solution or dispersion of a heat sealable coating medium having a dynamic viscosity of from 0.001 to 0.1 $Nsm^{-2}$ at 20° C., and by maintaining the peripheral velocity of the applicator roll within a range of from 0.001 to 0.4 of the forward speed of the film such that a layer of coating medium of equilibrium thickness not exceeding 5.0 mm is entrained on the surface of the applicator roll and thence transferred to a surface of the film.

The invention is illustrated by reference to the accompanying drawings in which.

Figure 1:
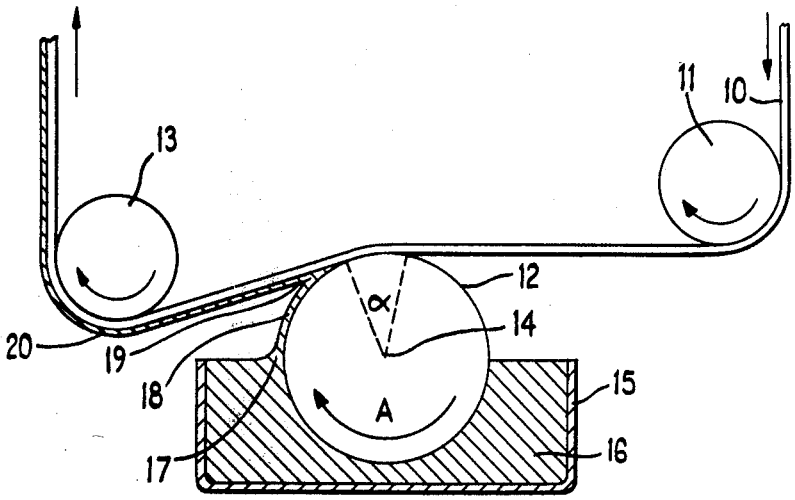
FIG. 1 is a schematic side elevation of a reverse roll coating assembly.

Referring to FIG. 1, a polymeric film web 10 is fed at a selected linear speed from a supply source (not shown) around idler roll 11, into contact with an arcuate portion of the surface of applicator roll 12, and is removed therefrom around idler roll 13 so positioned that the zone of contact between the web and applicator roll surface subtends an arc contact angle α of the order of 10° at the rotational axis 14 of the applicator roll.

Applicator roll 12 rotates, as indicated by arrow A, in a direction contrary to the direction of movement of web 10, and at a peripheral speed less than the linear speed of the web.

A bath 15 contains a volume of liquid coating medium 16 maintained at a depth such that the applicator roll is immersed therein to the level of its rotational axis 14. Surplus coating liquid overflowing from the bath can, if desired, be collected and recycled to the bath by means of suitable pumping equipment (not shown).

Rotation of applicator roll 12 creates a dynamic meniscus 17 of coating liquid which progressively forms an equilibrium layer 18 of relatively constant thickness at the roll surface as a balance is achieved between the amount of liquid entrained on the roll by surface tension and liquid inertia and that flowing back into the bath by virtue of gravity and viscosity factors. Contact between the web and applicator roll ensures virtually complete transfer of the coating medium from the surface of the roll to that of the web, the coating medium in equilibrium layer 18 being wiped into a wedge or bead 19 at the interface between the web and roll surface and thence into a uniform layer 20 on the web surface, the thickness of layer 20 being attenuated relative to that of equilibrium layer 18 in proportion to the speed differential between web 10 and roll 12.

Figure 2:
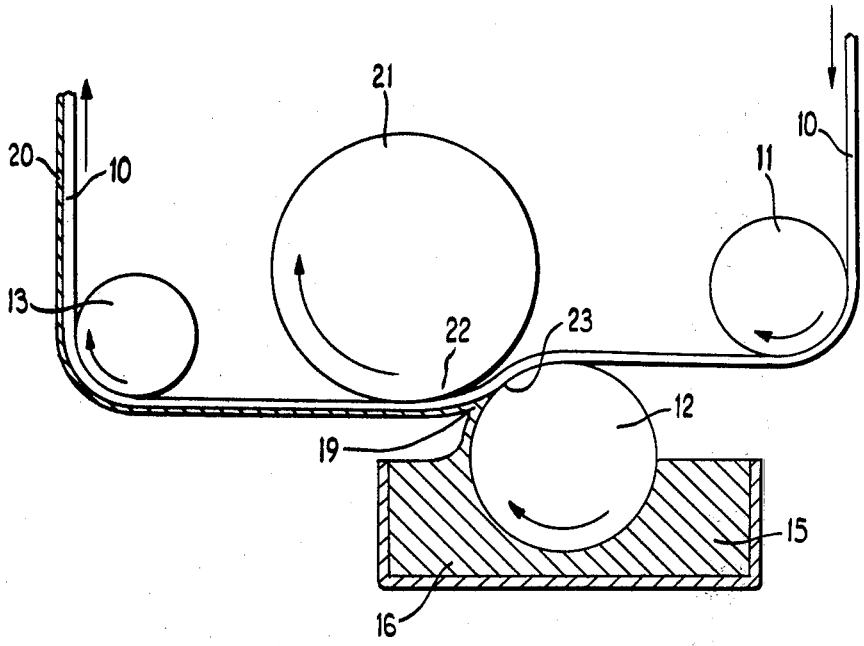
FIG. 2 is a schematic side elevation of a similar assembly incorporating a web stabilising roll.

FIG. 2 illustrates a system similar to that of FIG. 1 with the addition of web stabilising means in the form of a roll 21 of diameter exceeding that of applicator roll 12 and positioned relative thereto so that the initial point of contact 22 between the uncoated surface of web 10 and roll 21 is downstream, in the direction of travel of the web, of the point 23 at which the opposite surface of the web ceases to contact applicator roll 12. The proximal positioning of roll 21 relative to applicator roll 12 reduces vibration of web 10 thereby improving the stability of the wedge 19 of coating medium and ensuring that the latter is transferred smoothly to web 10 to form a highly uniform coating layer 20 on the web surface. Stabilising roll 21 may be independently driven at a suitable speed or may idle in contact with the web, and is suitably fabricated from a light metal such as aluminium.

Figure 3:
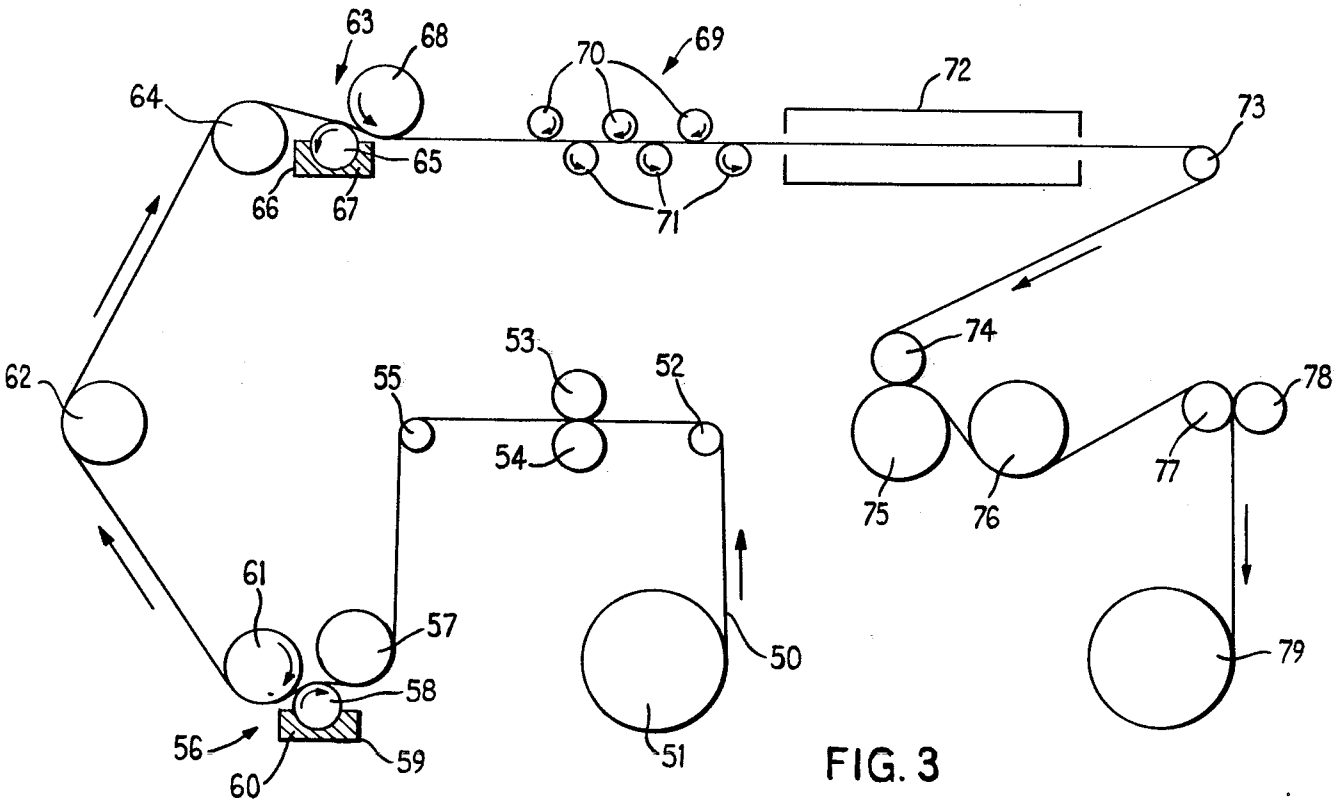
FIG. 3 is a schematic elevation, to a different scale, depicting sequential reverse roll coating of each surface of a web.

As shown in FIG. 3, a polyolefin web 50 is unwound from a supply roll 51 and fed around idler guide roll 52, through tension-controlling nip rolls 53, 54 and around idler roll 55 to a reverse roll coating assembly generally designated 56 comprising a feed roll 57, a relatively narrow diameter applicator roll 58, contra-rotating in a bath 59 of liquid coating medium 60, and a stabilising roll 61 of diameter exceeding that of applicator roll 58.

Stabilising roll 61, being in contact with the dry surface of web 50 is undriven, and allowed to co-rotate by frictional contact with the web.

The unilaterally coated web than traverses vacuum roll 62, which engages the uncoated web surface, and passes to a second reverse roll assembly, designated 63, for coating the second surface of the web, assembly 63 comprising a feed roll 64, an applicator roll 65, contra-rotating relative to the web in a bath 66 of liquid coating medium 67, and a stabilising roll 68 of greater diameter than that of applicator roll 65. Stabilising roll 68, being in contact with the initially coated surface of web 50, and therefore achieving only slight frictional engagement therewith, is driven at a speed substantially equal to that of the web, and preferably in a direction contrary to the direction of movement of the web to smooth, and eliminate bubbles from, the initially deposited coating layer.

The web, now coated on each surface, is fed through a bank 69 of smoothing rollers 70, 71, rollers 70 contra-rotating in contact with one surface of the coated web, and rollers 71 contra-rotating in contact with the other coated surface.

Subsequently, the coated web traverses an air float drying oven 72 in which the web is suspended on currents of warm air to ensure that the smoothed coatings are dried before making contact with a solid roll surface.

After traversing idler guide roll 73, the dried web passes through the nip between guide roll 74 and the first of two internally-refrigerated cooling rolls 75, 76, the web being cooled by intimate contact with the surfaces thereof, and is then fed between tension-controlling nip rolls 77, 78 and onto wind-up roll 79.

If desired, one or more heated rolls (not shown), maintained at a temperature between the glass transition temperature and melting temperature of the polymer, may be interposed in the web path between guide roll 73 and cooling roll 75 to flatten the web, integrate the coating and effect tensioned thermal relaxation of the web in the manner disclosed in U.K. Pat. No. 1,457,940.

The invention is further illustrated by reference to the following Examples.

EXAMPLE 1

The web to be coated was a biaxially oriented, heat-set and discharge treated polypropylene film 24 microns (μm) thick and 28 inches (711 mm) wide, having on each surface thereof a gravure coated anchor layer of about 0.5 gauge thickness (0.127 μm) of an interpolymerised resin containing 38.5 parts of styrene, 44 parts of ethyl acrylate, 2.5 parts of methacrylic acid, and 15 parts of acrylamide condensed with 5.2 parts of formaldehyde in n-butanol.

Using a coating assembly of the kind shown in FIGS. 2 and 3, i.e. with a stabiliser bar located downstream of the reverse applicator roll, an aqueous dispersion containing 42 wt % of a heat-sealable vinylidene chloride-acrylonitrile copolymer (88:12 by weight) and of dynamic viscosity 0.0057 $Nsm^{-2}$, measured with an Ostwald viscometer at 23° C., was continuously supplied to bath 59 (FIG. 3).

The second reverse roll assembly 63 was maintained in position and the film was fed therethrough, but coating medium was not supplied to bath 66, so that only the uppermost surface of the web passing through float oven 72 had a heat-sealable coating deposited thereon.

The anchor-coated polypropylene film web was fed through the system of FIG. 3 in the direction shown at a foward speed of 1499 feet/minute (7.62 m/s) so as to contact the applicator roll 58 over an arc contact angle of about 10°, the applicator roll having a diameter of 2 inches (50.8 mm) and being immersed up to its rotational axis in the liquid coating medium in bath 59.

Undriven stabilising bar 61 of diameter 5 inches (127 mm) was positioned so that the surface thereof was radially spaced apart from the surface of applicator roll 58 by about 0.0625 inch (1.6 mm).

The peripheral speed of the applicator roll in a clockwise direction, i.e. contrary to the direction of forward movement of the web, was adjusted to 47 feet/minute (0.239 m/s) so that substantially all of the coating medium picked up by the applicator roll was transferred to the web and smoothed thereon by spreading rolls 70 rotating contrary to the direction of movement of the web at a peripheral speed of about 0.6 of the forward speed thereof. The ratio of applicator roll to web speed was therefore 0.0314:1.

The coated web was dried in air float oven 72 at a temperature of about 140° C., and the thickness of the dried coating on the web was found to be 7.25 gauge (1.84 μm). The heat-sealable coating was of uniform thickness across the width of the web and exhibited good adhesion to the anchor-coated substrate. The optical properties of the coated film were excellent, the Gardner Haze value being 2.8 and the Gardner Gloss value being 103, comparable values for a similar film to which an identical coating had been applied by conventional techniques being 3.9 for Haze and 98 for Gloss.

From a knowledge of the dry coat thickness on the web (1.84 μm), the solids content of the aqueous coating dispersion (42 wt %), and the density of the heat-sealable copolymer (1.6 g/cm$^3$) it is possible to calculate that the total wet thickness of the coating deposited on the web by the applicator roll is $1.84 \times 1.6 \times 58/42 + 1.84 = 5.90$ μm.

From the ratio of the web speed to the applicator roll speed 7.62:0.239 it is therefore possible to show that the equilibrium thickness (h) of the coating medium entrained on the applicator roll is $0.0059 \times 7.62/0.239 = 0.1879$ mm. This value agrees well with that determined by observation of the applicator roll surface with a travelling microscope. The factor k in the hereinbefore specified relationship is therefore 5.12.

Relevant data from this Example are summarised in the accompanying Table.

EXAMPLES 2 to 7

The procedure of Example 1 was repeated save that the solids content of the vinylidene chloride-acrylonitrile copolymer in the aqueous coating medium (and hence the viscosity thereof) and the relative speeds of the applicator roll and web were varied in accordance with the schedule of the accompanying Table.

In each of these Examples film of comparable quality and characteristics to that of Example 1 was obtained.

EXAMPLES 8 and 9

In these Examples a procedure similar to that of the preceding Examples was adopted save that bath 59 (FIG. 3) was not supplied with aqueous coating medium, the latter being supplied instead to bath 66 so that only the underside of the web was coated with the heat-sealable medium, smoothed by contra-rotating rolls 71 and dried in air float oven 72.

The diameter of contra-rotating roll 65 was 3 inches (76.2 mm), and that of the undriven stabilising roll 68 was 5 inches (127 mm), the surfaces of the two rolls being radially spaced apart by about 0.0625 inch (1.6 mm).

Results are shown in the accompanying Table.

EXAMPLE 10

In this Example the coating assembly was set up in the manner of Example 1, and the aqueous heat-sealable coating dispersion, containing 36 wt % of the vinylidene chloride-acrylonitrile copolymer, supplied to bath 59, bath 66 not being supplied with coating medium.

The anchor-coated polypropylene film web was fed through the coating assembly at a constant speed of 300 feet/minute (1.52 m/s), and the peripheral speed of applicator roll 58 in a clockwise direction progressively increased from zero. Perfect coating behaviour was observed as the applicator roll speed progressively increased to 90 feet/minute (0.46 m/s), i.e. a ratio of applicator roll to web speed of 0.303:1. As the applicator roll speed was further increased above about 101 feet/minute (0.51 m/s), i.e. applicator to web speed ratio of 0.335:1, the uniformity of the coating applied to the web began to deteriorate and when the peripheral speed of the applicator roll was increased to above 120 feet/minute (0.61 m/s), i.e. applicator to web speed ratio of 0.4:1, surplus coating medium began to accumulate on the web surface upstream of smoothing rolls 70.

TABLE

| Example | A | B | C | D | E | F | G | H | I |
|---|---|---|---|---|---|---|---|---|---|
| 1 | 42 | 0.0057 | 0.239 | 7.62 | 0.0314 | 1.84 | 5.90 | 0.1879 | 5.12 |
| 2 | 42 | 0.0057 | 0.178 | 5.07 | 0.0351 | 1.84 | 5.90 | 0.1681 | 5.31 |
| 3 | 42 | 0.0057 | 0.117 | 2.97 | 0.0394 | 1.84 | 5.90 | 0.1497 | 5.84 |
| 4 | 40 | 0.0049 | 0.254 | 7.52 | 0.0338 | 1.90 | 6.46 | 0.1911 | 5.42 |
| 5 | 40 | 0.0049 | 0.203 | 5.88 | 0.0345 | 1.90 | 6.46 | 0.1872 | 5.94 |
| 6 | 40 | 0.0049 | 0.178 | 4.97 | 0.0358 | 1.90 | 6.46 | 0.1804 | 6.11 |
| 7 | 36 | 0.0039 | 0.157 | 2.84 | 0.0553 | 1.90 | 7.30 | 0.1320 | 5.37 |
| 8 | 36 | 0.0039 | 0.267 | 6.35 | 0.0420 | 1.90 | 7.30 | 0.1738 | 5.42 |
| 9 | 36 | 0.0039 | 0.191 | 3.81 | 0.0501 | 1.90 | 7.30 | 0.1457 | 5.37 |
| 10 | 36 | 0.0039 | 0.460 | 1.52 | 0.3026 | 23.30 | 89.60 | 0.2961 | 7.04 |

Notes to Table
A = Coating Dispersion - Solids Content (wt %)
B = Coating Dispersion - Dynamic Viscosity ($\eta$) at 23° C. ($Nsm^{-2}$)
C = Applicator Roll Speed (U) ($ms^{-1}$)
D = Web Speed ($ms^{-1}$)
E = C:D
F = Coat Thickness on Web - Dry (μm)
G = Coat Thickness on Web - Wet (μm)
H = Equilibrium Coat Thickness (h) on Applicator (mm)
$I = k = \frac{h}{\eta^{0.5}U^{0.5}}$

I claim:

1. A method of coating a surface of a web, consisting essentially of forwarding the web in contact with the surface of an applicator roll, supplying a flowable coating medium to the surface of the applicator roll in the absence of mechanical metering means cooperating with said applicator roll, and rotating the applicator roll in a direction contrary to the direction of forward movement of the web to transfer the coating medium from said applicator roll surface to said web surface wherein the dynamic viscosity of the coating medium and the peripheral velocity of the applicator roll are each selected in accordance with the relationship $$h = k\eta^{0.5}U^{0.5}$$

such that a layer of coating medium of equilibrium thickness not exceeding 5.0 mm is entrained on the surface of the applicator roll for transfer to the surface of the web, and the ratio of the peripheral velocity of the applicator roll to the forward speed of the web is maintained at a value not exceed 0.4:1, wherein h is the equilibrium thickness (mm) of the entrained coating medium on the applicator roll surface, k has a value of from 0.01 to 100, $\eta$ is the dynamic viscosity ($Nsm^{-2}$) of the coating medium, and U is the peripheral velocity ($ms^{-1}$) of the applicator roll.

2. A method according to claim 1 wherein the ratio of the peripheral velocity of the applicator roll to the forward speed of the web is from 0.015:1 to 0.15:1.

3. A method according to claim 1 wherein the dynamic viscosity of the coating medium is from 0.001 to 0.1 $Nsm^{-2}$ at 20° C.

4. A method according to claim 1 wherein k is from 0.25 to 25.

5. A method according to claim 1 wherein h is from 0.025 to 0.5 mm.

6. A method according to claim 1 wherein the wet thickness of the coating deposited on the web surface is from 0.1 to 25 μm.

7. A method according to claim 1 wherein the web cooperates with the surface of the applicator roll over an arc contact angle of from 8° to 45°.

8. A method according to claim 1 wherein the path of the web is stabilised against vibration downstream of the applicator roll.

9. A method according to claim 1 wherein the coating medium deposited on said web surface is heat sealable.

10. A method according to claim 1 wherein said web is an oriented polymeric film.

11. A method of producing a heat sealable polyolefin film consisting essentially of forwarding an oriented polyolefin film in contact with the surface of an applicator roll, supplying a solution or dispersion of a heat sealable coating medium to the surface of the applicator roll, rotating the applicator roll in a direction contrary to the direction of forward movement of the film to coat the film, and drying the coated film, wherein the film is maintained in contact with the applicator roll surface over an arc contact angle of from 5° to 90°, a solution or dispersion of a heat sealable coating medium having a dynamic viscosity of from 0.001 to 0.1 $Nsm^{-2}$ at 20° C. is supplied to the applicator roll surface, and the peripheral velocity of the applicator roll is maintained within a range of from 0.001 to 0.4 of the forward speed of the film such that a layer of coating medium of equilibrium thickness not exceeding 5.0 mm is entrained on the surface of the applicator roll and thence transferred to a surface of the film.

12. A method according to claim 1 wherein said web is a polymeric film.

* * * * *